US011946346B2

(12) United States Patent
Langlais et al.

(10) Patent No.: US 11,946,346 B2
(45) Date of Patent: Apr. 2, 2024

(54) GRAVEL PACKING LEAK OFF SYSTEM POSITIONED ACROSS NON-PERFORATED COUPLING REGION

(71) Applicant: Schlumberger Technology Corporation, Sugar Land, TX (US)

(72) Inventors: Michael Dean Langlais, Houston, TX (US); Julien Debard, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 218 days.

(21) Appl. No.: 17/431,497

(22) PCT Filed: Feb. 20, 2020

(86) PCT No.: PCT/US2020/019117

§ 371 (c)(1),
(2) Date: Aug. 17, 2021

(87) PCT Pub. No.: WO2020/172466

PCT Pub. Date: Aug. 27, 2020

(65) Prior Publication Data

US 2022/0136372 A1 May 5, 2022

Related U.S. Application Data

(60) Provisional application No. 62/807,812, filed on Feb. 20, 2019.

(51) Int. Cl.
*E21B 43/08* (2006.01)
*E21B 43/04* (2006.01)

(52) U.S. Cl.
CPC ..... *E21B 43/04* (2013.01); *E21B 43/08* (2013.01)

(58) Field of Classification Search
CPC ..... E21B 43/04; E21B 43/08
(Continued)

(56) References Cited

U.S. PATENT DOCUMENTS 6,749,023 B2 * 6/2004 Nguyen ..... E21B 43/267 166/278
7,562,709 B2 7/2009 Saebi et al.
(Continued)

FOREIGN PATENT DOCUMENTS

WO 2005045185 A1 5/2005
WO 2017155546 A1 9/2017

OTHER PUBLICATIONS

Bonner et al., 2014, Design and Validation of an Improved Shunt Tube System, SPE-169440 (21 pages).
(Continued)

*Primary Examiner* — William D Hutton, Jr.
*Assistant Examiner* — Ashish K Varma
(74) *Attorney, Agent, or Firm* — Jeffrey D. Frantz

(57) ABSTRACT

A technique facilitates dehydration of gravel slurry around blank pipe sections of a completion having filters for receiving carrier fluid returns. A sand screen filter system may be assembled with a first filter, a second filter, and a blank pipe section extending between the first filter and the second filter. A fixed leak off tube is mounted to the sand screen filter system such that at least a portion of the fixed leak off tube overlaps the first filter. Additionally, a slidable leak off tube is slidably mounted to the sand screen filter system. The slidable leak off tube is oriented to enable the slidable leak off tube to be slid along the blank pipe section until secured in fluid communication with the fixed leak off tube.

15 Claims, 7 Drawing Sheets

(58) Field of Classification Search
USPC ..... 166/278
See application file for complete search history.

(56) References Cited

U.S. PATENT DOCUMENTS

| | | | | |
|---|---|---|---|---|
| 2002/0079099 | A1* | 6/2002 | Hurst | E21B 43/045 166/278 |
| 2012/0018153 | A1* | 1/2012 | Yeh | E21B 43/04 166/278 |
| 2013/0248179 | A1* | 9/2013 | Yeh | E21B 33/124 166/305.1 |
| 2017/0022789 | A1* | 1/2017 | Hodge | E21B 43/088 |

OTHER PUBLICATIONS

International Search Report and Written Opinion issued in the PCT Application PCT/US2020/019117, dated Jun. 23, 2020 (15 pages).

* cited by examiner

GRAVEL PACKING LEAK OFF SYSTEM POSITIONED ACROSS NON-PERFORATED COUPLING REGION

CROSS-REFERENCE TO RELATED APPLICATION

This application is a national stage entry under 35 U.S.C. 371 of International Application No. PCT/US2020/019117, filed Feb. 20, 2020, which is based on and claims priority to U.S. Provisional Patent Application Ser. No. 62/807,812, filed Feb. 20, 2019, which is incorporated by reference in its entirety.

BACKGROUND

Gravel packs are used in wells for removing particulates from inflowing hydrocarbon fluids. Generally, a completion having a sand screen assembly or a plurality of sand screen assemblies is deployed downhole in a wellbore and a gravel pack is formed around the completion. During the gravel packing process, gravel slurry is directed downhole and dehydrated by taking returns of carrier fluid through the filters, e.g. sand screens, of the sand screen assemblies. As a result, the carrier fluid is separated from the gravel and the gravel is left in the annulus surrounding the completion to create a gravel pack.

However, the completion includes relatively long blank pipe sections located between the filters/sand screens. The blank pipe sections may comprise handling areas and a coupling for joining sand screen joints. Furthermore, the blank pipe sections do not have filter sections and thus do not have the ability to dehydrate the gravel slurry by taking returns of carrier fluid. The blank pipe sections are therefore susceptible to formation of gravel packs with voids due to the lack of dehydration. Over time, gravel from adjacent gravel packed areas surrounding the filters can settle into these blank pipe voids. This can result in a compromised gravel pack in the annulus surrounding the filters. Leak off tubes have been used to help dehydrate the slurry at these blank pipe sections. However, existing leak off tubes can present difficulties with respect to assembly and can provide insufficient dehydration of the slurry in this region.

SUMMARY

In general, a system and methodology are provided for facilitating dehydration of gravel slurry around blank pipe sections of a completion having filters for receiving carrier fluid returns. A sand screen filter system may be assembled with a first filter, a second filter, and a blank pipe section extending between the first filter and the second filter. A fixed leak off tube is mounted to the sand screen filter system such that at least a portion of the fixed leak off tube overlaps the first filter. Additionally, a slidable leak off tube is slidably mounted to the sand screen filter system. The slidable leak off tube is oriented to enable the slidable leak off tube to be slid along the blank pipe section until secured in fluid communication with the fixed leak off tube. The slidable leak off tube may similarly have at least a portion which overlaps the second filter. In other embodiments of the present disclosure, a single bi-directional slidable leak off tube that at least partially overlaps both the first and second filters in a final position may be implemented in the completion.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and:

FIG. 2 is an illustration of a portion of the completion in which a slidable leak off tube is slidably mounted, according to one or more embodiments of the present disclosure;

FIG. 3 is an illustration similar to that of FIG. 2 but showing the slidable leak off tube being slid towards a fixed leak off tube of the leak off tube system, according to one or more embodiments of the present disclosure;

DETAILED DESCRIPTION

Figure 1:
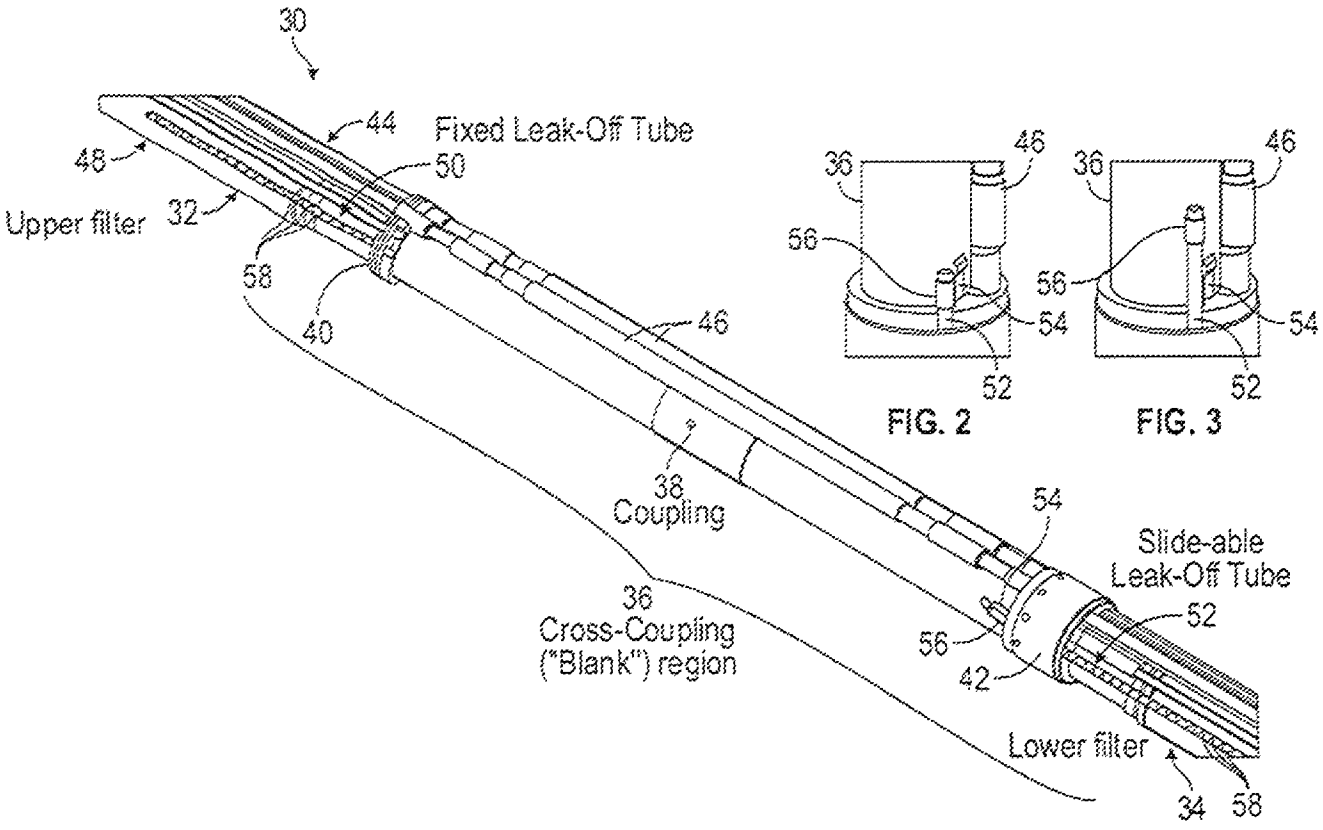
FIG. 1 is a schematic illustration of a portion of a completion constructed for deployment in a wellbore and having an embodiment of a leak off tube system, according to one or more embodiments of the present disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology to facilitate formation of gravel packs in wellbores and thus the subsequent production of well fluids. According to an embodiment, a system and methodology are provided for facilitating dehydration of gravel slurry around blank pipe sections of a completion having filters for receiving carrier fluid returns. By way of example, the completion may comprise a plurality of filters, e.g. sand screens, separated by one or more blank pipe sections. The filters enable the return of carrier fluid during gravel packing operations and subsequently serve to allow inflowing well fluids. In embodiments described herein, the blank pipe section is a non-perforated coupling region.

In various applications, a sand screen filter system may be assembled with a first filter, a second filter, and a blank pipe section extending between the first filter and the second filter. The sand screen filter system also comprises a leak off tube system having a fixed leak off tube and a slidable leak off tube. The fixed leak off tube may be mounted to the sand screen filter system such that at least a portion of the fixed leak off tube overlaps the first filter. Additionally, the slidable leak off tube may be slidably mounted to the sand screen filter system. The slidable leak off tube is oriented to enable the slidable leak off tube to be slid along the blank pipe section until secured in fluid communication with the fixed leak off tube. Furthermore, the slidable leak off tube may have at least a portion which overlaps the second filter.

By way of example, the fixed leak off tube and the slidable leak off tube may be small round (or otherwise suitably shaped) filter tubes having enclosed ends, e.g. capped ends. The leak off tubes are perforated with a plurality of perforations to provide filtration of inflowing fluid. By way of example, the perforations may be formed by cutting slots into a solid walled tube, however other types of leak off tubes may be formed from woven wire, wrapped wire, or via other suitable techniques for creating the perforations.

As described in greater detail below, the leak off tubes extend along the blank pipe section between filters and overlap at least one of the filters. In embodiments described below, the leak off tubes overlap both the first filter, e.g. the upper filter, and the second filter, e.g. the lower filter. The overlap between the leak off tube and the corresponding filter causes low pressure to be exerted on the leak off tube as carrier fluid is returned through the corresponding filter. The low pressure servers to draw carrier fluid into the leak off tube from the blank pipe section, e.g. similar to a straw used for drinking from the bottom of a glass. This "drinking" action dehydrates the region surrounding the blank pipe section to leave an improved gravel pack between the filters adjacent the blank pipe section. By utilizing leak off tubes which overlap both the first filter and the second filter, the effectiveness of the dehydration of the gravel slurry adjacent the blank pipe section is substantially improved. It should be noted the term "upper" is used to refer to the relative uphole side and the term "lower" is used to refer to the relative downhole side.

Referring generally to FIG. 1, an embodiment of a completion 30 is illustrated. The completion 30 may be a sand screen filter system deployed in a variety of wellbores, e.g. deviated wellbores or other types of wellbores. In this example, the completion 30 comprises a first filter 32, e.g. an upper filter, a second filter 34, e.g. a lower filter, and a blank pipe section 36 located between the first filter 32 and the second filter 34. In some embodiments, the filters 32, 34 and portions of the blank pipe section 36 are constructed as screen joints which may be joined via a coupling 38. The filters 32, 34 enable the return of carrier fluid which flows through the filters 32, 34 from an exterior to an interior of the completion 30 and then on to a surface collection location.

In the embodiment illustrated, the completion 30 further comprises a bracket 40 mounted about the blank pipe section 36 and a manifold 42 also mounted about the blank pipe section 36. By way of example, the bracket 40 may be mounted on one screen joint and the manifold 42 may be mounted on the adjacent screen joint joined via coupling 38. An alternate path system 44 may be mounted along an exterior of the first filter 32, blank pipe section 36, and second filter 34 to facilitate a thorough gravel packing of the annulus surrounding completion 30. The alternate path system 44 may comprise a plurality of conduits 46, e.g. tubes, joined with the manifold 42.

Additionally, the completion 30 comprises a leak off tube system 48 having a fixed leak off tube 50 and a slidable leak off tube 52 which are each mounted along the blank pipe section 36. By way of example, the fixed leak off tube 50 may be mounted to the bracket 40 so as to extend at least partially along one of the filters which, in the illustrated embodiment, is the upper filter 32. The slidable leak off tube 52 is slidably mounted for sliding motion along the blank pipe section 36. By way of example, the slidable leak off tube 52 may be slidably mounted to the manifold 42.

Before sliding the slidable leak off tube 52 into fluid communication with the fixed leak off tube 50, the slidable leak off tube 52 may be retained via a retention member 54, e.g. a spring tab, as further illustrated in FIG. 2. The retention member 54 may be used to temporarily hold the slidable leak off tube 52 when the fixed leak off tube 50 and the slidable leak off tube 52 are assembled on, for example, a rig.

The slidable leak off tube 52 comprises an engagement end 56 constructed for engagement with the bracket 40 when the slidable leak off tube 52 is slid a sufficient distance toward the fixed leak off tube 50 to place the slidable leak off tube 52 in fluid communication with fixed leak off tube 50. During assembly, the slidable leak off tube 52 may be slid in a longitudinal or axial direction so as to move engagement end 56 past retention member 54 and toward the fixed leak off tube 50, as illustrated in FIG. 3. It should be noted that each of the leak off tubes 50, 52 comprises a plurality of perforations 58 which may be formed through a solid weld tube, via wrapped wire, or via other suitable techniques.

Figures 4, 5, 6, 7, 8, 9, 10:
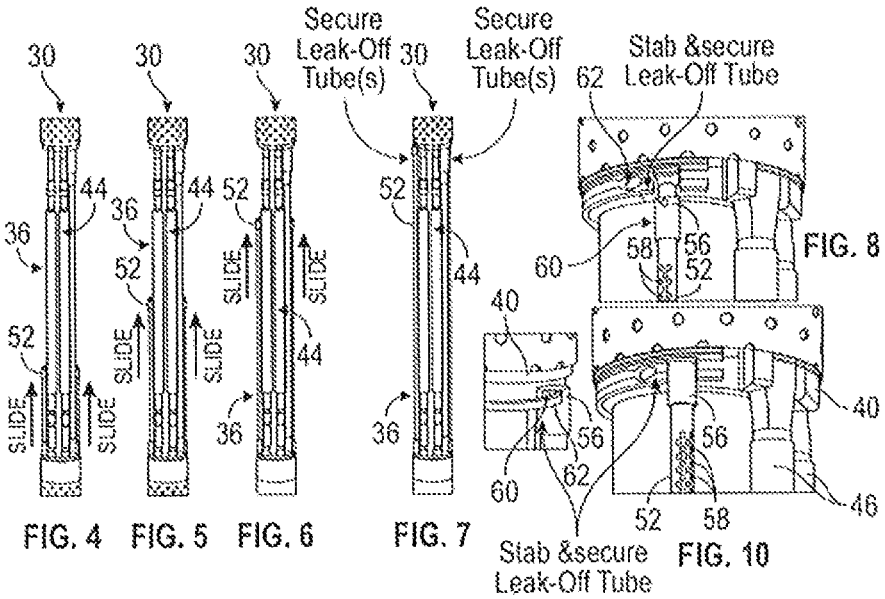
FIG. 4 is another illustration of the slidable leak off tube being slid towards the fixed leak off tube at a subsequent position of slidable movement, according to one or more embodiments of the present disclosure.
FIG. 5 is another illustration of the slidable leak off tube being slid towards the fixed leak off tube at a subsequent position of slidable movement, according to one or more embodiments of the present disclosure.
FIG. 6 is another illustration of the slidable leak off tube being slid towards the fixed leak off tube at a subsequent position of slidable movement, according to one or more embodiments of the disclosure.
FIG. 7 is another illustration of the slidable leak off tube but after completion of the slidable movement, according to one or more embodiments of the present disclosure.
FIG. 8 is an illustration of a bracket configured for secure engagement with an end of the slidable leak off tube when the slidable leak off tube is placed in fluid communication with the fixed leak off tube, according to one or more embodiments of the present disclosure.
FIG. 9 is an illustration of the slidable leak off tube engaged with the bracket, according to one or more embodiments of the present disclosure.
FIG. 10 is an illustration of the slidable leak off tube stabbed into the bracket and secured in engagement with the bracket for fluid communication with the fixed leak off tube, according to one or more embodiments of the present disclosure.
Figure 11:
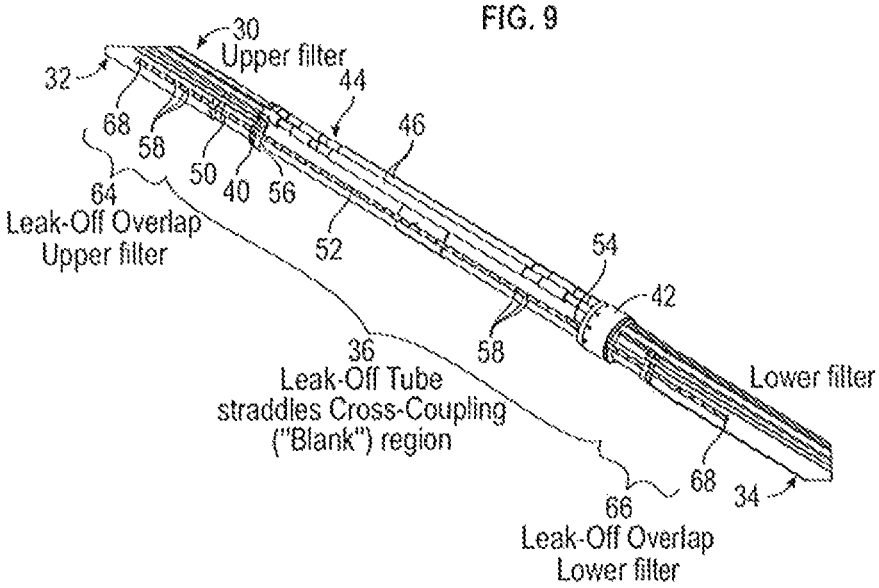
FIG. 11 is an illustration of an example of the completion system with the assembled leak off tube system, according to one or more embodiments of the present disclosure.

Referring generally to FIGS. 4-7, the slidable leak off tube 52 is illustrated at sequential stages of sliding as it is moved towards fixed leak off tube 50 and ultimately joined in fluid communication with fixed leak off tube 50, as illustrated in FIG. 7. By way of example, the engagement end 56 may comprise a latch feature 60, e.g. a pin, which is received in a corresponding latch feature 62, e.g. a recess, of bracket 40 as illustrated in FIGS. 8 and 9. Effectively, the slidable leak off tube 52 is stabbed into and secured with respect to the fixed leak off tube 50 to ensure fluid communication between the leak off tubes, as illustrated in FIGS. 10 and 11.

In this example, at least a portion of the fixed leak off tube 50 has an overlap region 64 with the upper filter 32. Similarly, a portion of the slidable leak off tube 52 has an overlap region 66 with lower filter 34 after the slidable leak off tube 52 is joined in fluid communication with the fixed leak off tube 50. In this manner, the fixed leak off tube 50 and the slidable leak off tube 52 are able to work together as a single tube to provide improved leak off capability. In other words, the fixed leak off tube 50 and the slidable leak off tube 52 provide a bi-directional leak off with respect to the corresponding upper filter 32 and lower filter 34, respectively, so as to draw carrier fluid away from the region of blank pipe section 36 during the gravel packing operation.

It should be noted the fixed leak off tube 50 and the slidable leak off tube 52 may each have closed or capped ends 68 at their respective distal ends. The opposite end of each of the fixed leak off tube 50 and the slidable leak off tube 52 is open to enable fluid communication therebetween once the slidable leak off tube 52 is slid into position for fluid communication with fixed leak off tube 50 (see FIG. 11).

Figure 12:
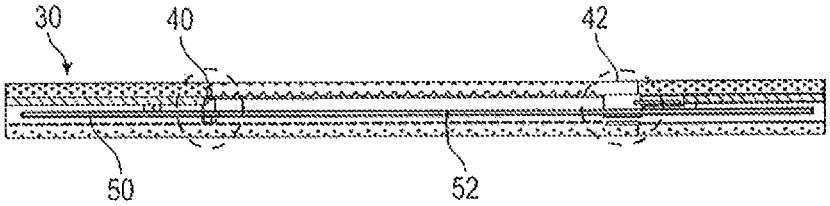
FIG. 12 is another illustration of an example of the completion system with the assembled leak off tube system in which the fixed leak off tube is fixed to a bracket and the slidable leak off tube is slidably mounted through a manifold, according to one or more embodiments of the present disclosure.
Figure 13:
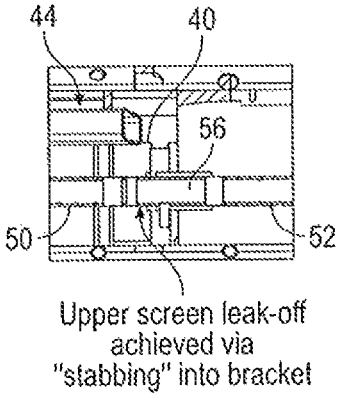
FIG. 13 is an enlarged illustration of the fixed leak off tube mounted in the bracket and the slidable leak off tube stabbed into fluid communication with the fixed leak off tube at the bracket, according to one or more embodiments of the present disclosure.
Figure 14:
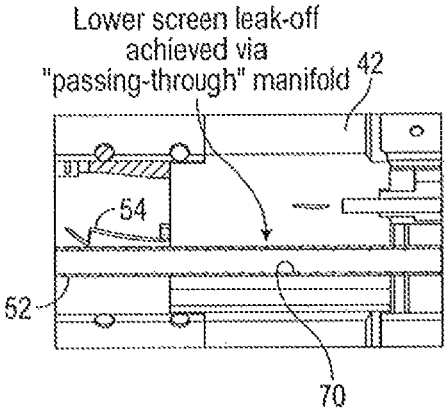
FIG. 14 is an enlarged view of the slidable leak off tube slidably mounted in a corresponding passage extending longitudinally through the manifold, according to one or more embodiments of the present disclosure.

Referring generally to FIGS. 12-14, an example is illustrated for mounting the fixed leak off tube 50 and the slidable leak off tube 52 along the blank pipe section 36. In this embodiment, the fixed leak off tube 50 is stabbed into bracket 40 (see FIG. 13) in a manner which provides a sand control seal on the open end of the fixed leak off tube 50 while establishing fluid communication with the slidable leak off tube 52. The slidable leak off tube 52 may be slidably mounted through manifold 42 via a corresponding passage 70 formed in a longitudinal/axial direction through the manifold 42 (see FIG. 14). Depending on the parameters of a given application, the relative positions of the leak off tubes 50, 52 and or the relative positions of mounting bracket/manifold 40, 42 may be changed, e.g. reversed.

During a gravel packing operation, returning carrier fluid flows into the interior of fixed leak off tube 50 and slidable leak off tube 52 via perforations 58. The carrier fluid moves along the interior of the leak off tubes 50, 52 until exiting the leak off tubes 50, 52 at the corresponding overlap regions 64, 66. The carrier fluid exits the leak off tubes 50, 52 at overlap regions 64, 66 and flows into the corresponding filters 32, 34 for transport back to the surface along the interior of completion 30. If perforations 58 are located proximate the corresponding filters 32, 34 in the overlap regions 64, 66, suitable placement of gravel particles in this region can be difficult.

Figure 15:
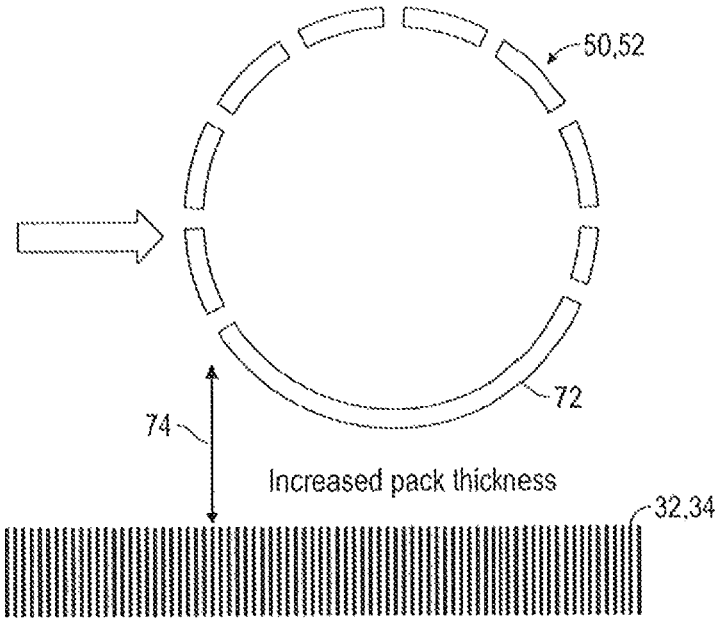
FIG. 15 is a schematic, cross-sectional illustration of an embodiment of the leak off tube having an arrangement of perforations, e.g. slots, which creates a solid wall portion oriented toward a corresponding filter of the completion, according to one or more embodiments of the present disclosure.

Accordingly, some embodiments of leak off tubes 50, 52 provide at least a section of the leak off tubes 50, 52 with a solid wall portion 72 which does not have perforations 58, as illustrated in FIG. 15. The solid wall portion 72 may be oriented toward the corresponding filter 32, 34 to provide an increased distance 74 between the closest perforations 58 and the corresponding filter 32, 34. This increased distance 74 enables formation of an improved gravel pack in this region with an increased gravel pack thickness. The bi-directional leak off tube system 48 and the solid wall portion 72 both serve to enhance the uniformity and dependability of the gravel pack. This, in turn, improves the functionality of the gravel pack during production operations.

Figures 16A, 16B, 16C, 16D:
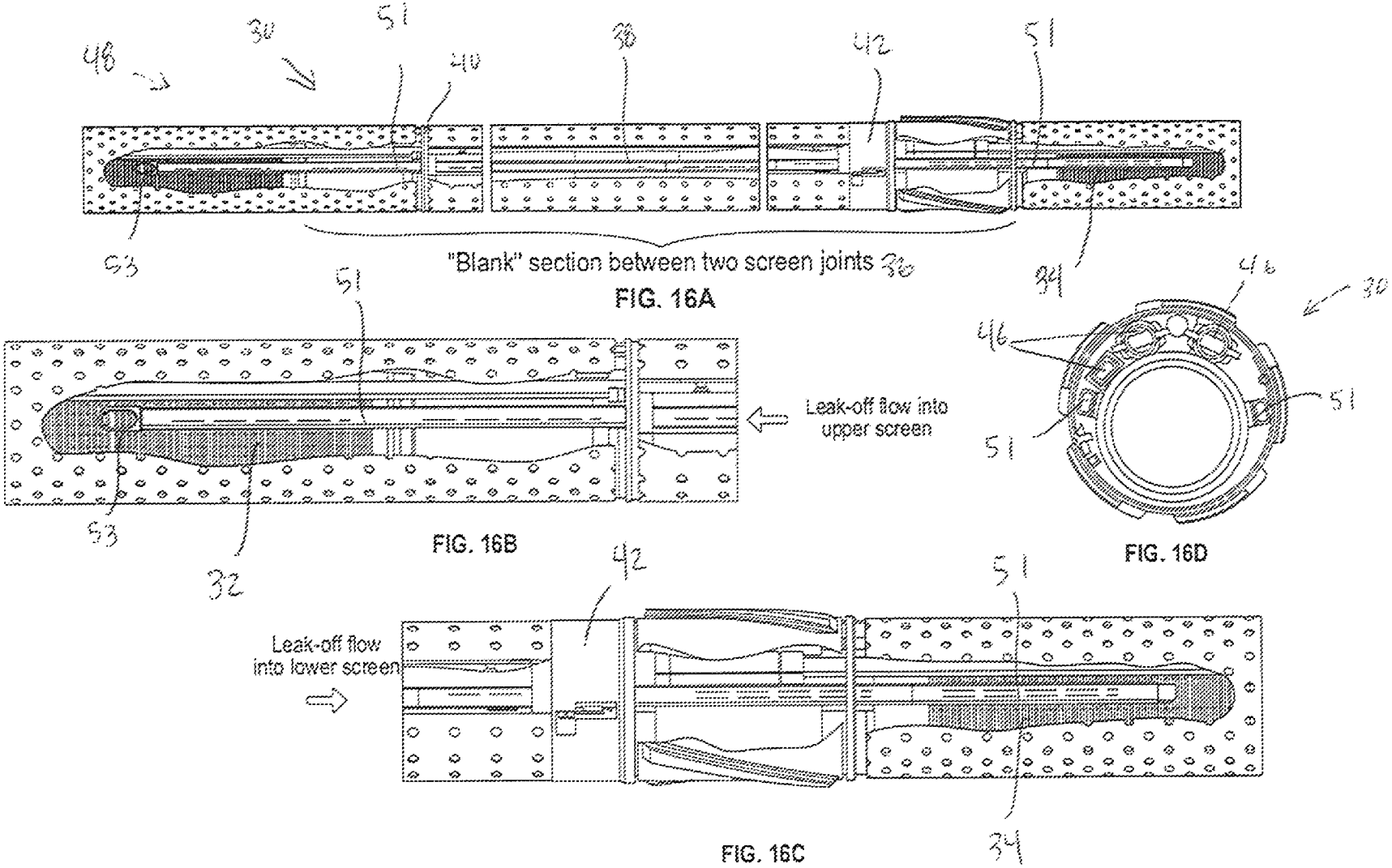
FIGS. 16A-C are schematic illustrations of a portion of a completion constructed for deployment in a wellbore and having an embodiment of a leak off tube system, according to one or more embodiments of the present disclosure.
FIG. 16D is a cross-section view of a completion showing a leak off tube duplicated on both sides of a joint according to one or more embodiments of the present disclosure.

Referring now to FIGS. 16A-C, schematic illustrations of a portion of a completion 30 having an embodiment of a leak off tube system 48 according to one or more embodiments of the present disclosure are shown. As previously described, the completion 30 according to one or more embodiments of the present disclosure may include a lower filter 34, an upper filter 32, and a blank pipe section 36 located between the lower filter 34 and the upper filter 32, as shown in FIGS. 16A-C. As further shown in FIGS. 16A-C, the completion 30 may include a bracket 40 mounted about the blank pipe section 36 and a manifold 42 mounted about the blank pipe section 36, as previously described. In one or more embodiments of the present disclosure, the manifold 42 and the bracket 40 of the completion 30 may be near opposing ends of the blank pipe section 36.

Still referring to FIGS. 16A-C, the leak off tube system 48 of the completion 30 may include a single bi-directional slidable leak off tube 51 slidably mounted in the manifold 42, according to one or more embodiments of the present disclosure. As shown in FIGS. 16A-C, once slidably installed, the single bi-directional slidable leak off tube 51 may at least partially overlap the lower filter 34, may be disposed within the manifold 42, may traverse the entirety of the blank pipe section 26, may be slid through the bracket 40, and may at least partially overlap the upper filter 32 in a final position. Advantageously, the single slidable leak off tube 51 according to one or more embodiments of the present disclosure is bi-directional as it takes in leak-off flow into both the upper filter 32 and the lower filter 34.

Still referring to FIGS. 16A-C, the single slidable leak off tube 51 according to one or more embodiments of the present disclosure may include an end 53 configured to stab through the bracket 40 as the single slidable leak off tube 51 is slid across the blank pipe section 36. In a final position of the single slidable leak off tube 51 according to one or more embodiments of the present disclosure, the single slidable leak off tube 51 at least partially overlaps both the lower filter 34 and the upper filter 32. In one or more embodiments of the present disclosure, the amount of overlap of the single slidable leak off tube 51 with the upper filter 32 and the lower filter 34 may be in a range of 5 inches to 20 inches, for example. However, the amount of overlap is not limiting, and other overlap ranges are contemplated and are within the scope of the present disclosure.

Referring now to FIG. 16D, a cross-section view of a completion 30 showing a single slidable leak off tube 51 duplicated on both sides of a joint according to one or more embodiments of the present disclosure is shown. For context and perspective, FIG. 16D also shows a plurality of conduits 46 of the alternate path system 44 according to one or more embodiments of the present disclosure. As shown in FIG. 16D, a single slidable leak off tubes 51 may be installed on each side of the joint for a total of two single slidable leak off tubes 51, for example. In this way, the two single slidable leak off tubes 51 are able to provide enhanced leak off capability when drawing carrier fluid away from the region of the blank pipe section 36 during a gravel packing operation.

Figure 17A:
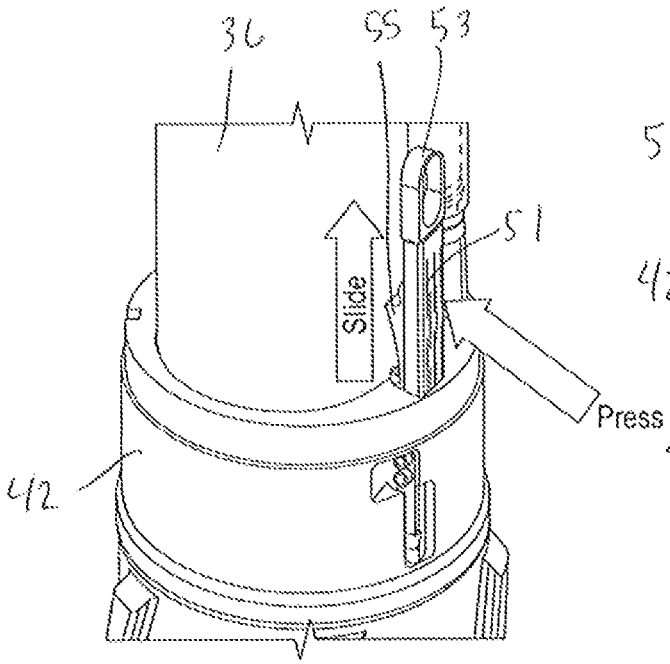
FIGS. 17A-C are illustrations of a slidable leak off tube being slid towards a final position that overlaps both upper and lower filters of a completion, according to one or more embodiments of the present disclosure.
Figure 17B:
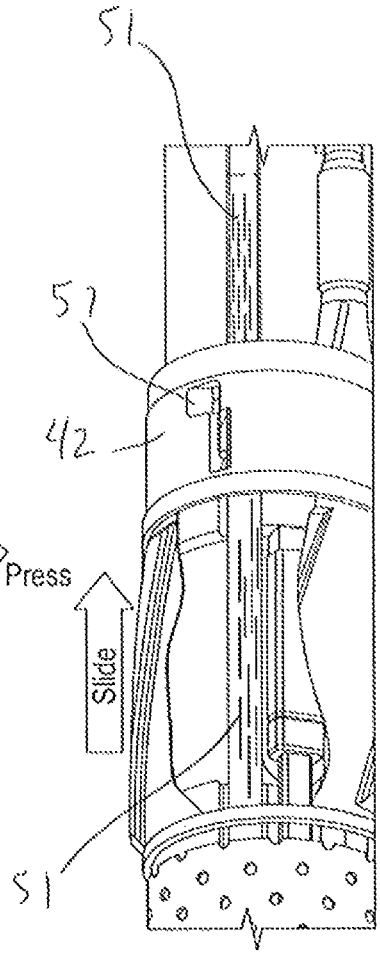
Figure 17C:
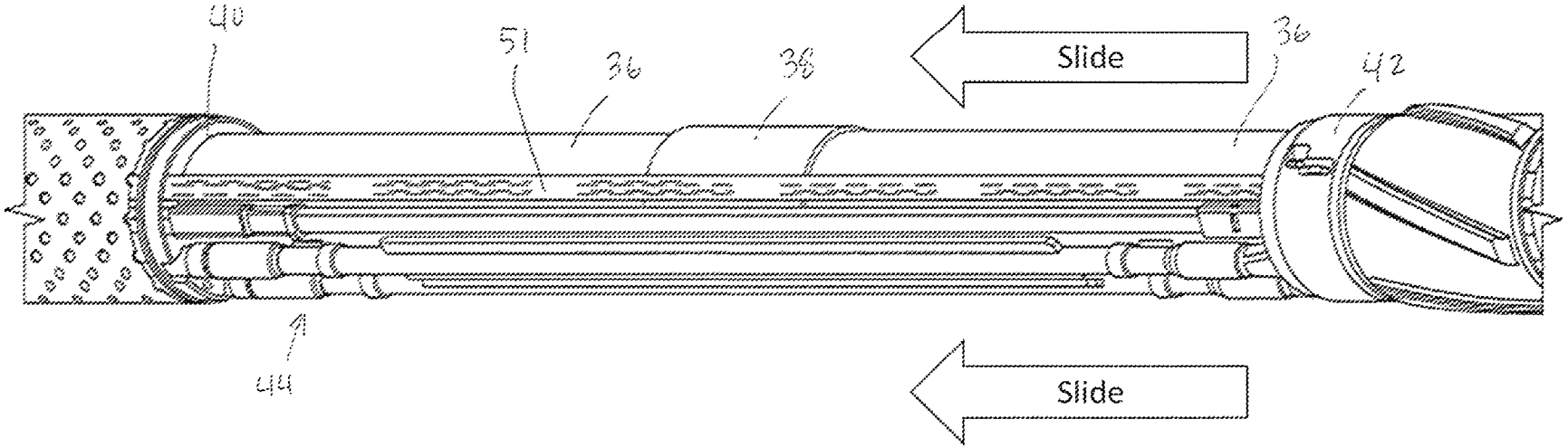

Referring now to FIGS. 17A-C, illustrations of a single slidable leak off tube 51 being slid towards a final position that overlaps both upper and lower filters of a completion 30, according to one or more embodiments of the present disclosure is shown. Specifically, FIG. 17A shows the single slidable leak off tube 51 having the end 53 slidably mounted in the manifold 42 mounted about the blank pipe section 36 of the completion. As further shown in FIG. 17A, the single slidable leak off tube 51 is supported by a tab 55. In operation, pressing of the tab 55 allows the single slidable leak off tube 51 to be fed through the manifold 42 and continue sliding across the blank pipe section 36.

Referring now to FIG. 17B, the single slidable leak off tube 51 continues to slide across the blank pipe section 36 as it is fed through the manifold 42. In one or more embodiments of the present disclosure, the single slidable leak off tube 51 includes a locking mechanism 57, such as a locking boss, for example, disposed thereon. As the single slidable leak off tube 51 is fed through the manifold 42, the locking mechanism 57 disposed on the single slidable leak off tube 51 is caught by a spring clasp disposed in the manifold 42 in one or more embodiments of the present disclosure. In such embodiments, the locking mechanism 57 deflects the spring clasp, and as the sliding continues, the spring clasp catches the locking mechanism 57, locking it into place in the manifold 42. While one type of locking mechanism 57 is illustrated, other locking mechanisms are within the scope of the present disclosure as long as the locking mechanism facilitates locking the single slidable leak off tube 51 in place.

Referring now to FIG. 17C, the single slidable leak off tube 51 continues to slide across the blank pipe section 36, during which an end of the single slidable leak off tube 51 stabs through the bracket 40. After stabbing through the bracket 40, the single slidable leak off tube 51 continues to slide until there is sufficient overlap between the upper filter 32 and the lower filter 34 in a final position of the single slidable leak off tube 51. Advantageously, the single slidable leak off tube 51 according to one or more embodiments of the present disclosure facilitates dehydration of gravel slurry around a blank pipe section 36 of a completion 30 from two directions for improved leak off capability without extraneous components.

As previously described and shown in the corresponding figures, the single slidable leak off tube 51 according to one or more embodiments of the present disclosure may be slid up from the manifold 42, as gravity facilitates the assembly of the slidable leak off tube 51 within the completion. However, the assembly method is not limiting, and the slidable leak off tube 51 may be slid down with respect to the manifold 42 during assembly without departing from the scope of the present disclosure.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, the system comprising:
- a completion having:
  - a lower filter;
  - an upper filter;
  - a blank pipe section located between the lower filter and the upper filter;
  - a bracket mounted about the blank pipe section at a first filter comprising one of the upper filter or the lower filter;
  - a manifold mounted about the blank pipe section at a second filter comprising the other one of the upper filter or the lower filter; and
  - a leak off tube system, the leak off tube system comprising:
    - a fixed leak off tube mounted to the bracket and extending at least partially along the first filter; and
    - a slidable leak off tube slidably mounted in the manifold, the slidable leak off tube having an engagement end configured to:
      - slide along the blank pipe section toward the fixed leak off tube;
      - engage the bracket once the slidable leak off tube is slid a sufficient distance toward the fixed leak off tube to be in fluid communication with the fixed leak off tube; and
      - extend at least partially along the second filter after the engagement end is engaged with the bracket.

2. The system as recited in claim 1, wherein the slidable leak off tube is capped.

3. The system as recited in claim 1, wherein the fixed leak off tube and the slidable leak off tube are each perforated with a plurality of perforations.

4. The system as recited in claim 3, wherein the perforations comprise slots.

5. The system as recited in claim 3, wherein the fixed leak off tube and the slidable leak off tube each have a solid wall portion without perforations, the solid wall portion being oriented toward the corresponding upper and lower filters.

6. The system as recited in claim 1, wherein the completion further comprises an alternate path system mounted along an exterior of the upper filter, the lower filter, and the blank pipe section.

7. A method, comprising:
- assembling a sand screen filter system for use in a well, the sand screen filter system comprising a completion having:
  - a lower filter;
  - an upper filter;
  - a blank pipe section located between the lower filter and the upper filter;
  - a bracket mounted about the blank pipe section at a first filter comprising one of the upper filter or the lower filter;
  - a manifold mounted about the blank pipe section at a second filter comprising the other one of the upper filter or the lower filter; and
  - a leak off tube system;
- mounting a fixed leak off tube, of the leak off tube system, to the bracket, such that at least a portion of the fixed leak off tube extends at least partially along the first filter; and
- slidably mounting a slidable leak off tube, of the leak off tube system, in the manifold, at an orientation enabling the slidable leak off tube to be slid a sufficient distance along the blank pipe section toward the fixed leak off tube until an engagement end of the slidable leak off tube engages the bracket to secure the slidable leak off tube in fluid communication with the fixed leak off tube and extend at least partially along the second filter after the engagement end is engaged with the bracket.

8. The method as recited in claim 7, further comprising perforating the fixed leak off tube and the slidable leak off tube with a plurality of perforations.

9. The method as recited in claim 8, further comprising arranging the perforations to create a solid wall portion without perforations, the solid wall portion being oriented toward the corresponding upper and lower filters.

10. The method as recited in claim 7, further comprising mounting an alternate path system along an exterior of the upper filter, the lower filter, and the blank pipe section.

11. A system for use in a well, the system comprising:

a completion having:

a lower filter;

an upper filter;

a blank pipe section located between the lower filter and the upper filter;

a bracket mounted about the blank pipe section at a first filter comprising one of the upper filter or the lower filter;

a manifold mounted about the blank pipe section at a second filter comprising the other one of the upper filter or the lower filter; and a leak off tube system, the leak off tube system comprising a slidable leak off tube, wherein:

the slidable leak off tube is slidably mounted in the manifold;

the slidable leak off tube is configured to slide along the blank pipe section toward the bracket at the first filter;

the slidable leak off tube has an end configured to stab through the bracket as the slidable leak off tube is slid along the blank pipe section into contact with the bracket; and the slidable leak off tube at least partially overlaps both the lower filter and the upper filter after the end is stabbed through the bracket.

12. The system of claim 11, the leak off tube system further comprising a locking mechanism that cooperates with a spring clasp in the manifold during sliding to lock the slidable leak off tube in place.

13. The system as recited in claim 11, wherein the slidable leak off tube is capped.

14. The system as recited in claim 11, wherein the the slidable leak off tube is perforated with a plurality of perforations.

15. The system as recited in claim 11, wherein the slidable leak off tube has a solid wall portion without perforations, the solid wall portion being oriented toward the upper filter and the lower filter.

* * * * *